US010459368B2

(12) United States Patent
Inokuchi et al.

(10) Patent No.: US 10,459,368 B2
(45) Date of Patent: Oct. 29, 2019

(54) POWDER DETECTOR, CONTROL METHOD OF SAME, AND IMAGE FORMING APPARATUS INCORPORATING SAME

(71) Applicant: RICOH COMPANY, LTD., Tokyo (JP)

(72) Inventors: Sumihiro Inokuchi, Kanagawa (JP); Hiroshi Adachi, Kanagawa (JP); Masashi Hommi, Kanagawa (JP); Naohiro Funada, Kanagawa (JP); Norio Muraishi, Tokyo (JP); Kengo Tanaka, Tokyo (JP); Shingo Nishizaki, Kanagawa (JP); Masaki Karakawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/181,648

(22) Filed: Nov. 6, 2018

(65) Prior Publication Data

US 2019/0196360 A1 Jun. 27, 2019

(30) Foreign Application Priority Data

Dec. 22, 2017 (JP) ..... 2017-246945

(51) Int. Cl.
*G03G 15/08* (2006.01)
*G03G 15/00* (2006.01)

(52) U.S. Cl.
CPC ..... *G03G 15/0858* (2013.01); *G03G 15/556* (2013.01); *G03G 2215/0888* (2013.01)

(58) Field of Classification Search
CPC ..... G03G 15/0824; G03G 15/0825; G03G 15/0831; G03G 15/0849; G03G 15/0851; G03G 15/0856; G03G 15/0858; G03G 2215/0888
See application file for complete search history.

(56) References Cited

U.S. PATENT DOCUMENTS

| | | | | |
|---|---|---|---|---|
| 9,523,664 | B2 * | 12/2016 | Hirota | G01M 7/02 |
| 9,523,940 | B2 * | 12/2016 | Hosokawa | G03G 15/0858 |
| 9,817,335 | B2 * | 11/2017 | Kawashima | G03G 15/0858 |
| 10,228,632 | B2 * | 3/2019 | Yamamoto | G03G 15/0858 |
| 2016/0116860 | A1 * | 4/2016 | Hirota | G01M 7/02 399/27 |
| 2017/0185002 | A1 * | 6/2017 | Jang | G03G 15/0862 |

FOREIGN PATENT DOCUMENTS

| | | |
|---|---|---|
| JP | 2016-109445 | 6/2016 |

* cited by examiner

*Primary Examiner* — Thomas S Giampaolo, II
(74) *Attorney, Agent, or Firm* — Xsensus LLP

(57) ABSTRACT

A powder detector includes a driver to drive a motor, a stirrer to stir powder in a vessel, a vibration plate disposed in the vessel and vibrated by a flip of the stirrer rotated by the motor, and circuitry. The circuitry detects a vibration of the vibration plate, estimates an amount of powder based on a detection result of the vibration, and causes the driver to drive the motor from a starting point, so as to move the stirrer to a preset halt position. The starting point is a rotation angle of the motor on detection of the vibration.

8 Claims, 14 Drawing Sheets

POWDER DETECTOR, CONTROL METHOD OF SAME, AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2017-246945, filed on Dec. 22, 2017, in the Japan Patent Office, the entire disclosure of which is hereby incorporated by reference herein.

BACKGROUND

Technical Field

This disclosure generally relates to a powder detector, a control method of the powder detector, and an image forming apparatus incorporating the powder detector.

Description of the Related Art

There are known image forming apparatuses that employ electrophotography. In electrophotographic image formation, an electrostatic latent image formed on a photoconductor is developed into a visible image. The visible image on the photoconductor is transferred onto a recording medium. Developer used in electrophotographic image forming apparatuses is generally powder called toner. Toner is supplied from a supply source to a developing device via a vessel called a sub-hopper. The toner in the sub-hopper is stirred by a rotating stirrer, raked out from the sub-hopper, and transported to the developing device by a screw.

As toner is depleted in the supply source, toner in the sub-hopper is also depleted. Accordingly, the presence or absence of toner in the supply source, such as a toner bottle, can be determined based on an amount of toner in the sub-hopper.

SUMMARY

According to an embodiment of the present disclosure, an improved powder detector includes a driver to drive a motor, a stirrer to stir powder in a vessel, a vibration plate disposed in the vessel and vibrated by a flip of the stirrer rotated by the motor, and circuitry. The circuitry detects a vibration of the vibration plate, estimates an amount of powder based on a detection result of the vibration, and causes the driver to drive the motor from a starting point, so as to move the stirrer to a preset halt position. The starting point is a rotation angle of the motor on detection of the vibration.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
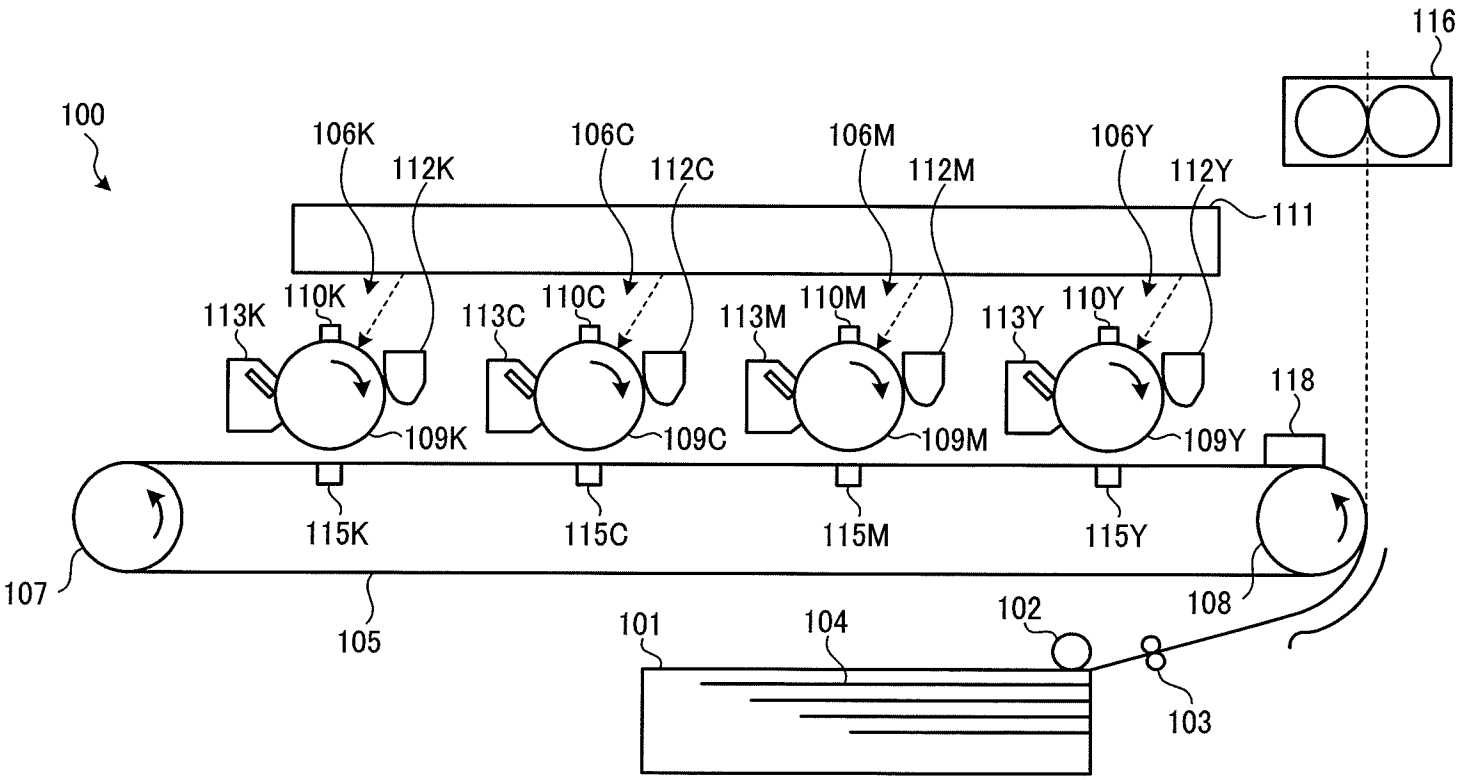
FIG. 1 is a schematic view illustrating an image forming mechanism in an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring now to the drawings, descriptions are provided of embodiments of a powder detector, a control method of the powder detector, and an image forming apparatus in detail. In the embodiments, as a rotating stirrer stirs toner that is powder having flowability, the stirrer flips a vibration plate, and an amount of toner to be stirred by the stirrer is estimated based on displacement of the vibration plate. The position at which the stirrer flips the vibration plate is detected based on the displacement of the vibration plate, and the stirrer is moved to a predetermined halt position, which is set in advance to stop the stirrer when power is turned off or printing is paused.

According to an embodiment of the present disclosure, descriptions are given below of detection of the amount of toner remaining in a vessel, which is called a sub-hopper, to store toner between a developing device, which develops an electrostatic latent image on a photoconductor, and a container that is a supply source of toner as a developer.

FIG. 1 is a schematic view illustrating an image forming mechanism in an image forming apparatus 100 according to an embodiment of the present disclosure. The image forming apparatus 100 illustrated in FIG. 1 is a so-called tandem-type image forming apparatus and includes image forming units 106K, 106C, 106M, and 106Y for respective colors of yellow (Y), magenta (M), cyan (C), and black (K), arranged along a conveyance belt 105 in a direction of rotation of the conveyance belt 105. Suffixes Y, M, C, and K represent yellow, magenta, cyan, and black, respectively.

In the tandem-type image forming apparatus, respective color images Y, M, C, and K of the image forming units 106Y, 106M, 106C, and 106K are transferred and superimposed in this order onto the conveyance belt 105 serving as an intermediate transfer belt. A full-color image, in which the respective color images Y, M, C, and K are superimposed, is collectively transferred onto a recording medium 104, fixed by a fixing device 116, and ejected to the outside of the image forming apparatus 100. The recording medium 104 is separated and fed from a bundle of recording media 104 in a sheet feeding tray 101 by a sheet feeding roller 102.

In descriptions below, the image forming units 106Y, 106M, 106C, and 106K are collectively referred as the image forming units 106 as needed.

A pair of registration rollers 103 temporally stops the recording medium 104 fed from the sheet feeding tray 101 and forwards the recording medium 104 to a secondary-transfer nip (a secondary-transfer position) where the recording medium 104 contacts the conveyance belt 105, timed to coincide with a leading end of the full-color image superimposed on the conveyance belt 105.

The image forming units 106Y, 106M, 106C, and 106K have a similar configuration except the color of toner images. The image forming unit 106K forms black toner images, the image forming unit 106M forms magenta toner images, the image forming unit 106C forms cyan toner images, and the image forming unit 106Y forms yellow toner images. The image forming unit 106Y is described below as an example of the image forming units 106Y, 106M, 106C, and 106K.

The conveyance belt 105 is an endless belt looped around a drive roller 107 and a driven roller 108. The drive roller 107 is rotated by a drive motor.

Among the four image forming units 106, the image forming unit 106Y is the first to transfer toner images onto the conveyance belt 105. The image forming unit 106Y includes a photoconductor drum 109Y and components disposed around the photoconductor drum 109Y, namely, a charger 110Y, an optical writing device 111, a developing device 112Y, a drum cleaner 113Y, and a discharger. The optical writing device 111 irradiate lights with the photoconductor drums 109Y, 109M, 109C, and 109K for respective colors Y, M, C, and K.

Similarly to the image forming unit 106Y, the image forming units 106M, 106C, and 106K include chargers 110M. 110C, and 110K, developing devices 112M, 112C, and 112K, drum cleaners 113M, 113C, and 113K, and dischargers, respectively. Since the image forming units 106 have a similar configuration, descriptions of the image forming units 106M, 106C, and 106K are omitted, unless otherwise specified. The same optical writing device 111 exposes the image forming units 106Y, 106M, 106C, and 106K.

To form images, for example, the charger 110Y uniformly charges the outer circumferential surface of the photoconductor drum 109Y in the dark, and then the optical writing device 111 directs light from a light source corresponding to yellow images to the photoconductor drum 109Y, thus forming an electrostatic latent image thereon. The developing device 112Y develops the electrostatic latent image into a visible image with yellow toner. Thus, a yellow toner image is formed on the photoconductor drum 109Y.

The toner image is transferred by a transfer device 115Y onto the conveyance belt 105 at a primary-transfer nip (a primary-transfer position) where the photoconductor drum 109Y contacts or is closest to the conveyance belt 105. Thus, the yellow toner image is formed on the conveyance belt 105. After the toner image is primarily transferred onto the conveyance belt 105, residual toner remaining on the surface of the photoconductor drum 109Y is removed by the drum cleaner 113Y. The discharger eliminates electric charges remaining on the surface of the photoconductor drum 109Y for the next image forming operation.

The yellow toner image formed on the conveyance belt 105 by the image forming unit 106Y is transported to the next image forming unit 106M as the conveyance belt 105 is rotated by the drive roller 107. The image forming unit 106M forms a magenta toner image on the photoconductor drum 109M through the processes similar to the processes performed by the image forming unit 106Y. The magenta toner image is transferred from the photoconductor drum 109M and superimposed on the yellow toner image.

The yellow and magenta toner images on the conveyance belt 105 are further transported to the image forming units 106C and 106K, where cyan and black toner images are formed on the photoconductor drums 109C and 109K through the similar processes, respectively, and the cyan and black toner images are transferred and superimposed on the transferred toner images on the conveyance belt 105. Thus, a full-color intermediate toner image is formed on the conveyance belt 105.

The recording media 104 contained in the sheet feeding tray 101 are sent out from the top sequentially. At a position where a conveyance path leading therefrom contacts or is closest to the conveyance belt 105, the full-color intermediate toner image is transferred from the conveyance belt 105 onto the recording medium 104. Thus, an image is formed on the recording medium 104. The recording medium 104 carrying the image is transported to a fixing device 116, where the image is fixed on the recording medium 104. Then, the recording medium 104 is ejected outside the image forming apparatus 100.

The conveyance belt 105 is provided with a belt cleaner 118. As illustrated in FIG. 1, the belt cleaner 118 is disposed downstream from the secondary-transfer position, at which an image is transferred from the conveyance belt 105 to the recording medium 104, and upstream from the photoconductor drum 109Y in the direction of rotation of the conveyance belt 105. A cleaning blade of the belt cleaner 118 is pressed against the conveyance belt 105. Specifically, the cleaning blade of the belt cleaner 118 contacts the surface of the conveyance belt 105 and scrapes residual toner adhering to the surface of the conveyance belt 105.

Figure 2:
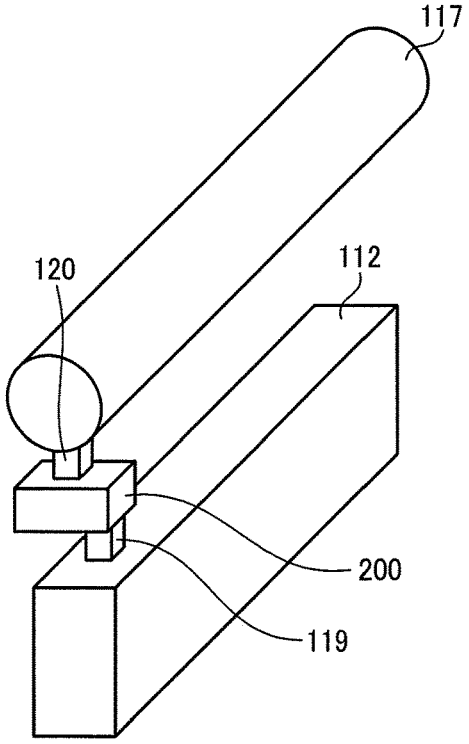
FIG. 2 is a perspective view illustrating a configuration for toner supply according to an embodiment of the present disclosure.

FIG. 2 is a perspective view illustrating a configuration for toner supply according to the present embodiment. A developing device 112 is described below on behalf of the developing devices 112Y, 112M, 112C, and 112K. The configuration for toner supply is configured to supply toner to the developing device 112. The configurations for toner supply of cyan (C), magenta (M), yellow (Y), and black (B) toners are similar to each other. Thus. FIG. 2 illustrates the configuration to supply one of the four toners to the corresponding developing device 112. As illustrated in FIG. 2, a first toner supply passage 120 extends from a toner bottle (a predetermined container) 117 to the sub-hopper 200 as the vessel and a second toner supply passage 119 extends from a sub-hopper 200 to the developing device 112. Toner contained in the toner bottle 117 is supplied through the first toner supply passage 120 to the sub-hopper 200.

The sub-hopper 200 is the vessel that temporarily stores toner supplied from the toner bottle 117 and supplies toner to the developing device 112 according to the amount of toner remaining in the developing device 112. From the sub-hopper 200, toner is supplied through the second toner supply passage 119 to the developing device 112. When toner in the toner bottle 117 is depleted, toner is not supplied to the sub-hopper 200. Therefore, the powder detector (a toner detector) to be described later is provided to detect a state in which the amount of toner is insufficient inside the sub-hopper 200.

Figure 3:
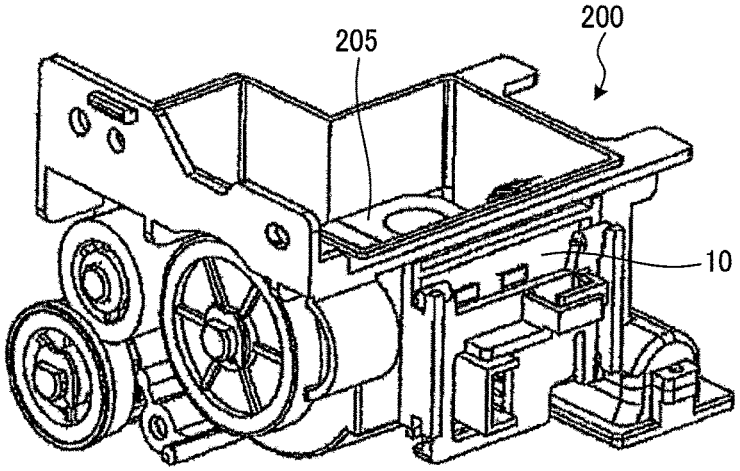
FIG. 3 is a perspective view illustrating an exterior of a sub-hopper according to an embodiment of the present disclosure.

FIG. 3 is a perspective view illustrating an exterior of the sub-hopper 200 according to the present embodiment. As illustrated in FIG. 3, a sensor 10 is attached to an outer surface of a housing of the sub-hopper 200. In FIG. 3, an upper side of the sub-hopper 200 is open, and a cover of the first toner supply passage 120 is attached to the open of the sub-hopper 200. An attachment portion of the cover matches with a shape of opening of the sub-hopper 200, thereby preventing toner from scattering outside. Toner stored in the sub-hopper 200 is discharged through the second toner supply passage 119 illustrated in FIG. 2 to the developing device 112.

Figure 4A:
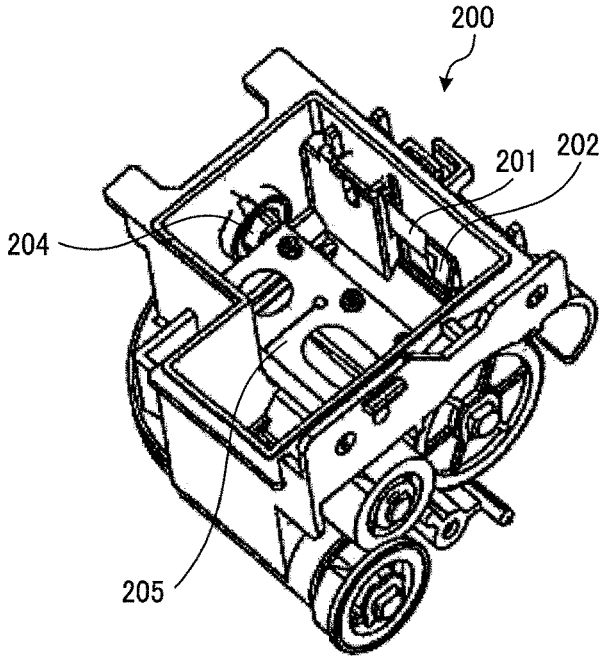
FIGS. 4A and 4B are a perspective view and a plan view illustrating an internal configuration of the sub-hopper according to an embodiment of the present disclosure.
Figure 4B:
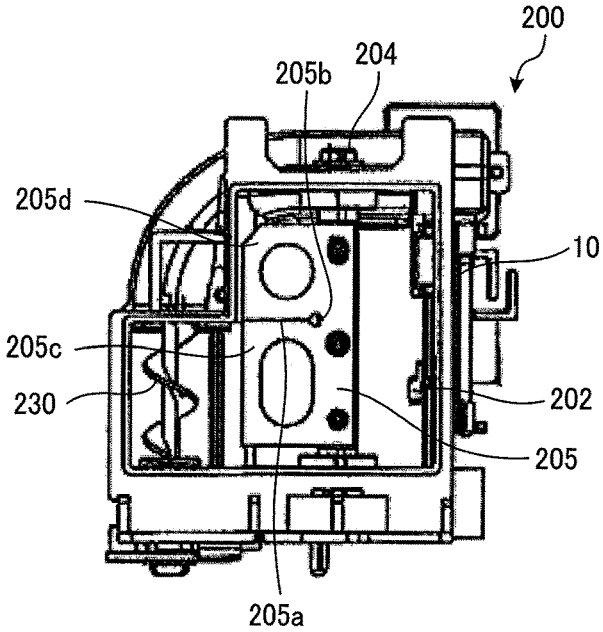

FIGS. 4A and 4B are a perspective view and a plan view illustrating an internal configuration of the sub-hopper 200 according to the present embodiment. As illustrated in FIGS. 4A and 4B, a vibration plate 201 is attached to an inner surface of the housing of the sub-hopper 200. Specifically, the vibration plate 201 is attached to the inner surface on the back of the outer surface of the housing to which the sensor 10 is attached in FIG. 3. Accordingly, the vibration plate 201 is disposed facing the sensor 10 via the housing of the sub-hopper 200.

The vibration plate 201 is a rectangular plate made of elastic material, for example, stainless steel. A first end of a long side of the vibration plate 201 is secured to the housing of the sub-hopper 200, and a second end of the long side is not secured. Thus, the vibration plate 201 is cantilevered. A weight 202 is attached to the second end of the long side of the vibration plate 201. The weight 202 is used for vibrating the vibration plate 201 and for adjusting the vibration frequency when the vibration plate 201 vibrates.

A rotary shaft 204 and a stirrer 205 are disposed inside the sub-hopper 200 to stir toner contained therein. The rotary shaft 204 rotates inside the sub-hopper 200. The stirrer 205 is secured to the rotary shaft 204. As the rotary shaft 204 rotates, the stirrer 205 stirs toner contained inside the sub-hopper 200 by rotation of the stirrer. The long side of the vibration plate 201 is substantially parallel to the axial direction of the rotary shaft 204. Toner inside the sub-hopper 200 is transported to a screw 230 by the stirrer 205 and supplied to the developing device 112 by the screw 230.

The stirrer 205 has a function to flip, by rotation of the stirrer 205, the weight 202 attached to the vibration plate 201 in addition to toner stirring function. Each time the stirrer 205 makes one rotation, the stirrer 205 flips the weight 202, and the vibration plate 201 vibrates. To ensure the toner stirring function and the function to flip the weight 202, a slit 205*a* is disposed near the center of the stirrer 205 in the present embodiment, and a vibration portion 205*c* and a stir portion 205*d* are provided across the slit 205*a*. The stirrer 205 is preferably non-magnetic material with flexibility. As such a material, for example, there is a resin, and more specifically polyethylene terephthalate (PET) can be applied.

The sensor 10 is for detecting displacement of the vibration plate 201. The configuration of the sensor 10 is not particularly limited as long as the displacement of the vibration plate 201 can be detected. For example, a magnetic flux sensor capable of detecting magnetic flux that varies according to the distance to the vibration plate 201 can be used.

As an example of the magnetic flux sensor, a magnetic flux sensor can be applied, which uses an oscillation circuit based on a Colpitts LC oscillation circuit. In such a case, the vibration plate 201 is, for example, made of stainless steel (SUS). The magnetic flux sensor oscillates at the resonance frequency corresponding to the inductance L formed by a planar pattern coil, a resistance value R. and a capacitance C to generate magnetic flux. As the magnetic flux penetrates through the vibration plate 201, eddy current is generated in the vibration plate 201.

The eddy current generated in the vibration plate 201 generates magnetic flux opposite to the magnetic flux by the magnetic sensor, and the magnetic flux penetrates the planar pattern coil. Therefore, the inductance L of the oscillation circuit and the resonance frequency of the oscillation circuit change. Specifically, the resonance frequency of the oscillation circuit increases when the vibration plate 201 approaches the planar pattern coil and decreases when the vibration plate 201 moves away from the planar pattern coil. In a case in which the vibration plate 201 is in a steady state without vibrating, the oscillation circuit oscillates at a constant resonance frequency.

The oscillation circuit is configured to output square wave corresponding to the resonance frequency. The vibration of the vibration plate 201 can be detected based on a count value obtained by counting the square wave output from the above-described magnetic flux sensor in a predetermined time unit.

When the vibration plate 201 is not displaced and in a steady state, the count value increases in a constant increase rate. Further, when the vibration plate 201 is periodically displaced in a vibration state, the count value increases according to an increase rate that increases or decreases corresponding to a cycle of the displacement of the vibration plate 201. A difference value of the count value is sequentially obtained according to time series. The difference value is a constant value (e.g., "0") in the steady state of the vibration plate 201 and a value vibrating across the constant value in the vibration state. The steady state and the vibration state of the vibration plate 201 can be detected based on the difference value. That is, the different value is the constant value in the steady state and repeats values higher and lower than the constant value in the vibration state. Hereinafter, the difference value is referred as an output value based on an output of the sensor 10.

The sensor 10 detects the vibration of the vibration plate 201 according to a change of the resonance frequency, and a timing at which the stirrer 205 has flipped the vibration plate 201 is detected.

The sensor 10 is not limited to the above-described embodiment and can output a voltage corresponding to the detected magnetic flux. As such a sensor 10, various configurations, such as a configuration using a Hall element, a configuration using a magnetoresistive effect element or a magnetic impedance element, a configuration using a coil, and the like can be applied. In these cases, the weight 202 is configured to generate magnetic flux, and thus, the sensor 10 can detect the magnetic flux generated by the weight 202. For example, the weight 202 includes a magnet.

Figure 5:
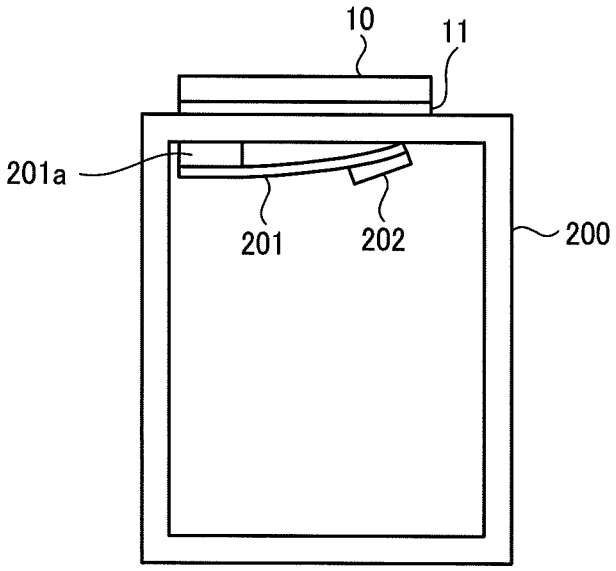
FIG. 5 is a schematic view illustrating a configuration of the sub-hopper according to an embodiment of the present disclosure, focusing on a vibration plate and a sensor.

Referring to FIGS. 5 to 11B, descriptions are provided of operations of the vibration plate 201 and the stirrer 205. FIG. 5 is a schematic view illustrating a configuration of the sub-hopper 200, focusing on the vibration plate 201 and the sensor 10 according to the present embodiment.

In FIG. 5, the vibration plate 201 is secured to the inner surface of the sub-hopper 200 via a mount (a spacer) 201*a* having a predetermined thickness. The weight 202 is disposed on a tip of the vibration plate 201. On the other hand, the sensor 10 is disposed opposite the vibration plate 201 via the housing of the sub-hopper 200. The sensor 10 is secured to the sub-hopper 200 by a fixing member 11 such as a double-sided tape.

Figure 6A:
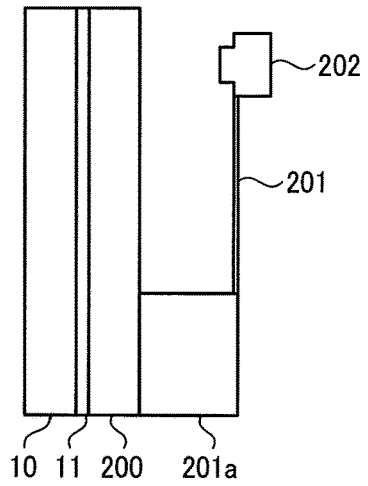
FIGS. 6A to 6C are schematic views illustrating movement of the vibration plate in response to added force.
Figure 6B:
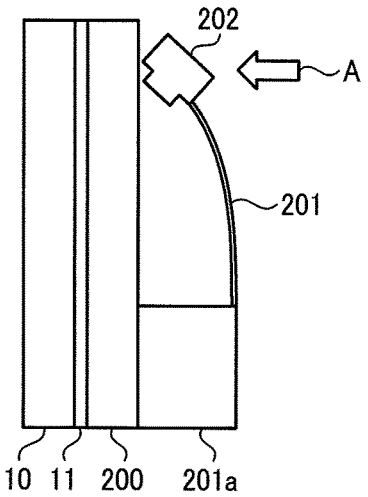
Figure 6C:
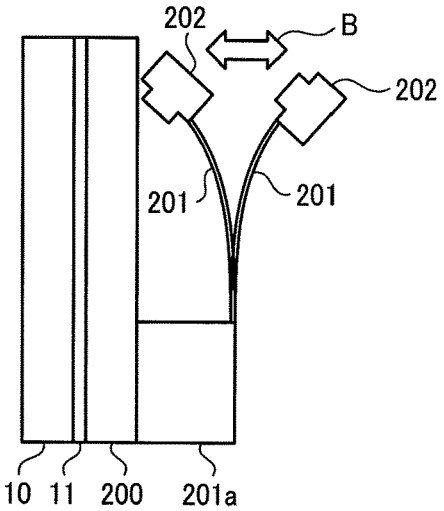

FIGS. 6A to 6C are schematic views illustrating movement of the vibration plate 201 in response to added force. Note that, in FIGS. 6A to 6C, identical reference numerals are assigned to components that are identical to the components illustrated in FIG. 5 and description of the identical components is omitted.

In FIG. 6A, force is not added to the vibration plate 201. In this state, the vibration plate 201 is kept parallel to the sensor 10 (i.e., the steady state). Accordingly, a distance between the vibration plate 201 and the sensor 10 is constant, and the resonance frequency by the sensor 10 is constant. The output value based on the output of the sensor 10 in this state is a reference value.

In FIG. 6B, the force from inside to outside of the housing of the sub-hopper 200 is added to the vibration plate 201 as indicated by arrow A. In this state, the vibration plate 201 is bent toward the housing and closer to the sensor 10 than the state illustrated in FIG. 6A. Therefore, the resonance frequency by the sensor 10 and the output value based on the output of the sensor 10 become higher than the steady state.

In FIG. 6C, the force added to the vibration plate 201 is released from the state illustrated in FIG. 6B. In this state, the vibration plate 201 is vibrated due to elasticity thereof and alternately bent outward and inward of the housing of the sub-hopper 200 relative to the position of the vibration plate 201 in the steady state (i.e., the vibration state). Therefore, the output value based on the output of the sensor 10 repeats values higher and lower than the constant state at a predetermined cycle.

Figure 7:
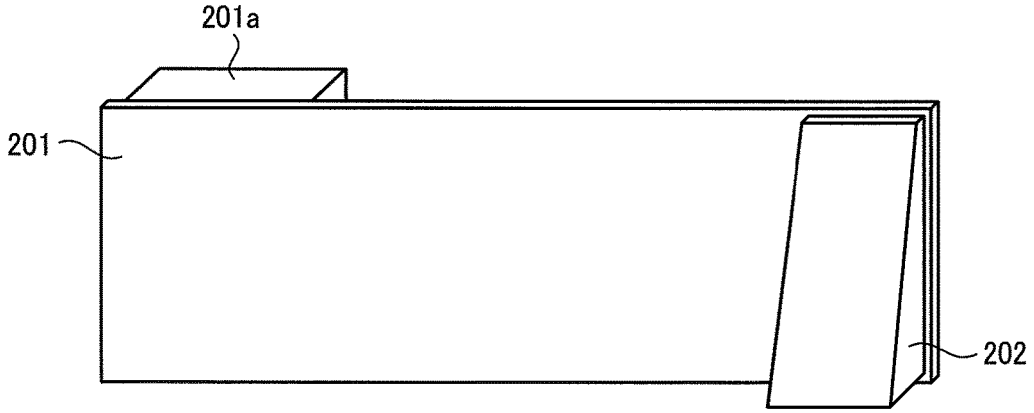
FIG. 7 is a perspective view illustrating a relative position around the vibration plate according to an embodiment of the present disclosure.
Figure 8A:
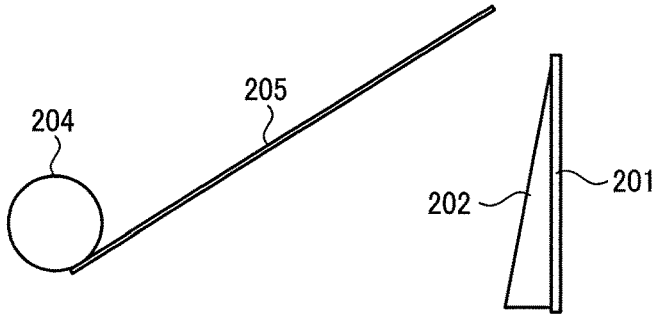
FIGS. 8A to 8C are schematic views illustrating a relation between rotational movement of a stirrer and movement of the vibration plate according to an embodiment of the present disclosure.
Figure 8B:
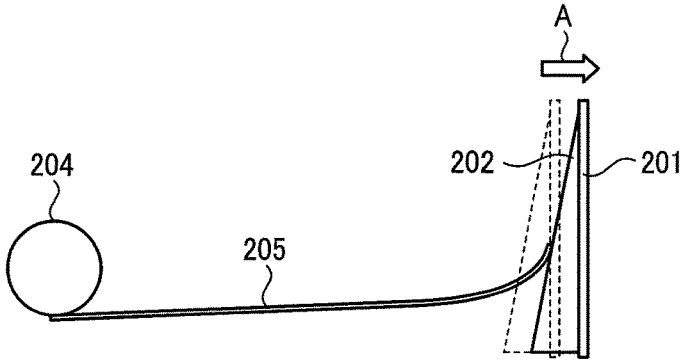
Figure 8C:
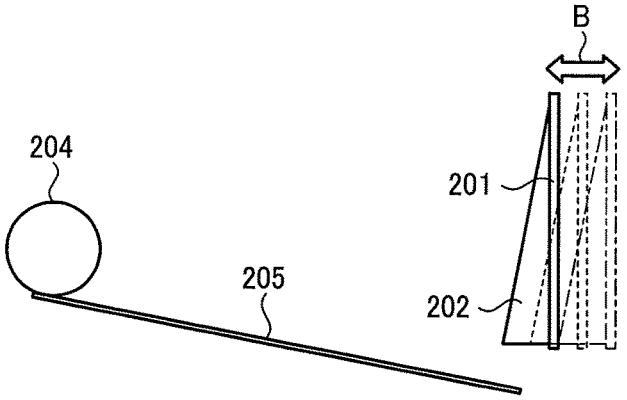

Referring to FIGS. 7 to 8C, descriptions are schematically provided of the relation of the rotation of the stirrer 205 and the movement of the vibration plate 201 according to the present embodiment. FIG. 7 is a perspective view illustrating an arrangement relation around the vibration plate 201 according to the present embodiment. As illustrated in FIG. 7, the vibration plate 201 is secured via a mount 201*a* to the housing of the sub-hopper 200.

FIGS. 8A to 8C are schematic views illustrating a relation between rotational movement of the stirrer 205 and movement of the vibration plate 201. The stirrer 205 rotates about a rotary shaft 204 as a rotation center. FIGS. 8A to 8C correspond to the states illustrated in FIGS. 6A to 6C, respectively. The stirrer 205 rotates about the rotary shaft 204 clockwise in FIGS. 8A to 8C.

FIG. 8A corresponds to the states illustrated in FIG. 6A. The stirrer 205 is not in contact with the weight 202 attached to the vibration plate 201, and the vibration plate 201 is in the steady state. The weight 202 projects from a face of the vibration plate 201 and inclined relative to the face of the vibration plate 201 when viewed from a lateral side. Specifically, the weight 202 has an inclined face that approaches the rotary shaft 204 along the direction of rotation of the stirrer 205. The inclined face of the weight 202 is pushed by a tip of the stirrer 205 in the radial direction relative to the rotation center when the stirrer 205 flips the vibration plate 201 to vibrate the vibration plate 201.

FIG. 8B corresponding to the state in FIG. 6B illustrates the state in which the stirrer 205 further rotates from the position illustrated in FIG. 8A. As the stirrer 205 further rotates while the tip of the stirrer 205 in the radial direction relative to the rotation center (hereinafter, simply referred to as the tip of the stirrer 205) keeps in contact with the weight 202, the vibration plate 201 is pushed and deformed in the direction illustrated by arrow A in FIG. 8B according to the inclined face of the weight 202. In FIG. 8B, broken lines represent positions of the vibration plate 201 and the weight 202 in the steady state.

Figure 9:
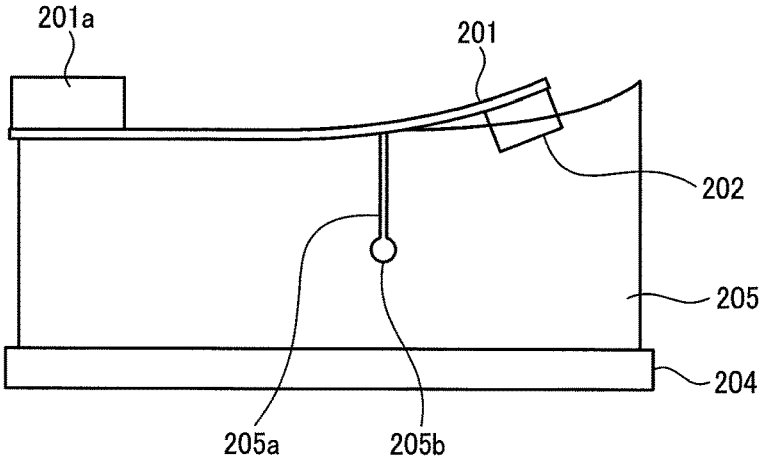
FIG. 9 is a schematic view illustrating a state in which a tip of the stirrer is in contact with a weight, and the vibration plate is pressed according to an embodiment of the present disclosure.

FIG. 9 is a schematic top view illustrating a state illustrated in FIG. 8B. The tip of the stirrer 205 according to the present embodiment contacts the weight 202, and the vibration plate 201 is pressed. Since the vibration plate 201 is secured via the mount 201*a* to the inner surface of the housing of the sub-hopper 200, the position of the first end of the vibration plate 201 on the side of the mount 201*a* does not change. By contrast, the second end, opposite to the first end, of the vibration plate 201, at which the weight 202 is disposed, is pushed by the stirrer 205 and moves to the side opposite to the rotary shaft 204. Accordingly, the vibration plate 201 deforms to the opposite direction to the rotary shaft 204 from the mount 201*a* as a base point, as illustrated in FIG. 9. The deformed vibration plate 201 stores energy to vibrate the vibration plate 201.

As illustrated in FIG. 9, the stirrer 205 includes a slit 205*a* positioned between the vibration portion 205*c* to contact the weight 202 and the stir portion 205*d* other than the vibration portion 205*c*. With this configuration, even if the stirrer 205 receives strong force while pushing the weight 202, damage to the stirrer 205 is inhibited. A round hole 205*b* is provided at the start point of the slit 205*a*. When the amount of deformation differs between the portions adjoining via the slit 205*a* (i.e., the vibration portion 205*c* and the stir portion 205*d*), the round hole 205*b* disperses the stress given to the start point of the slit 205*a*, thereby inhibiting damage to the stirrer 205.

FIG. 8C corresponding to the state in FIG. 6C illustrates the state in which the stirrer 205 further rotates from the position illustrated in FIG. 8B and the tip of the stirrer 205 separates from the inclined face of the weight 202. In FIG. 8C, broken lines represent the position of the vibration plate 201 in the steady state, and alternate long and short dashed lines represent the position of the vibration plate 201 that is pressed by the stirrer 205 and deformed, illustrated in FIG. 8B. When the energy, which has been accumulated by the stirrer 205 pushing the vibration plate 201, is released, the vibration plate 201 deforms to the opposite side as represented by solid lines. As illustrated by arrow B in FIG. 8C, the vibration plate 201 (the weight 202) is vibrated across the position of the vibration plate in the steady state.

Each time the stirrer 205 makes one rotation, the tip of the stirrer 205 flips the vibration plate 201, and the vibration plate 201 vibrates.

A description is provided of a case in which the stirrer 205 rotates while the sub-hopper 200 stores toner.

Figure 10:
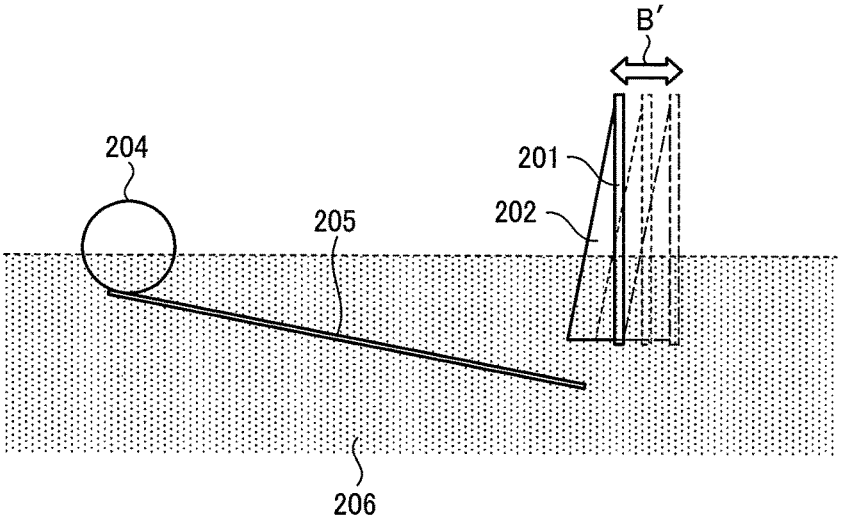
FIG. 10 is a schematic view illustrating a state in which toner is contained in the sub-hopper.

FIG. 10 is a schematic view illustrating a state in which toner 206 is contained in the sub-hopper 200. When toner 206 is present in the sub-hopper 200 as illustrated by hatching of dots in FIG. 10, the vibration plate 201 contacts the toner 206 while vibrating. Accordingly, since toner 206 becomes resistance to vibration of the vibration plate 201, the vibration of the vibration plate 201 indicated by arrow B' in FIG. 10 attenuates earlier than a case in which toner 206 is not present in the sub-hopper 200. Based on changes in attenuation of vibration, the amount of remaining toner in the sub-hopper 200 can be detected.

Figure 11A:
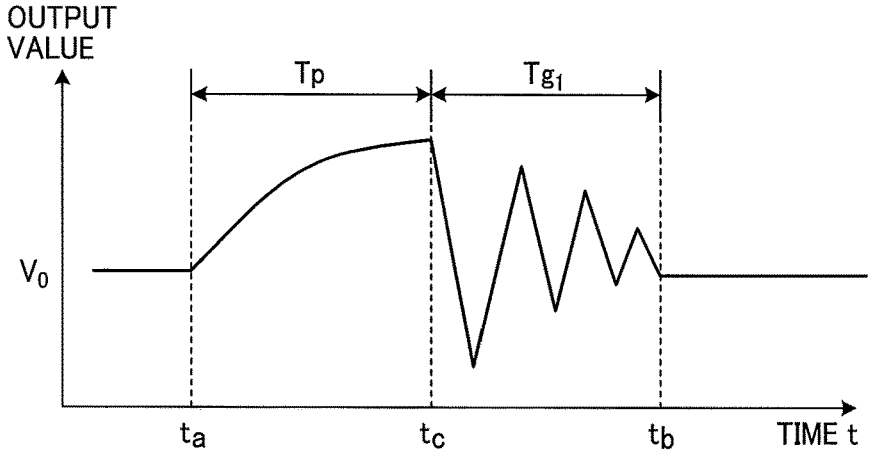
FIGS. 11A and 11B are graphs illustrating changes in an output of the sensor corresponding to the presence or absence of toner in the sub-hopper according to an embodiment of the present disclosure.
Figure 11B:
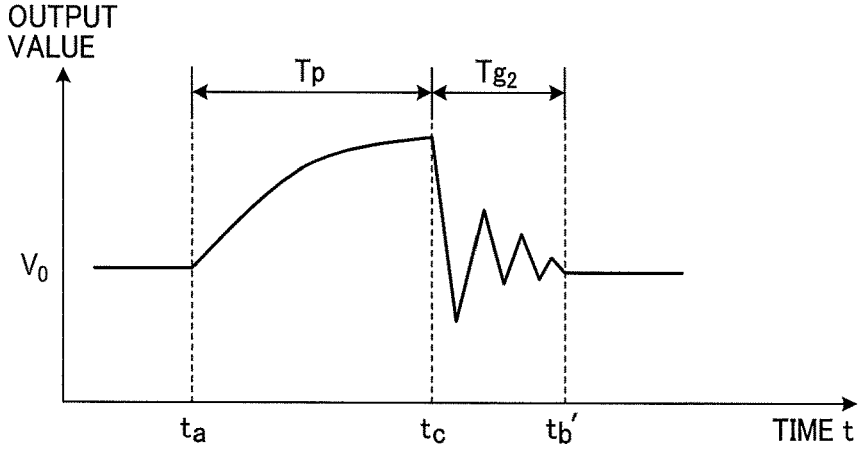

FIGS. 11A and 11B are graphs illustrating changes of the output value based on the output of the sensor 10 corresponding to the presence or absence of toner 206 in the sub-hopper 200. FIGS. 11A and 11B illustrate examples of the output value based on the output of the sensor 10 according to the present embodiment. In FIGS. 11A and 11B, a vertical axis represents the output value based on the output of the sensor 10, and a horizontal axis represents a time t. A reference value $V_0$ is indicated on the vertical axis.

In the examples in FIGS. 11A and 11B, the output value based on the output of the sensor 10 indicated by the vertical axis corresponds to the distance between the sensor 10 and vibration plate 201. Accordingly, when the distance between the sensor 10 and vibration plate 201 is longer than that in the steady state, the output value is smaller than the reference value $V_0$. On the other hand, the distance is shorter than that in the steady state, the output value is greater than the reference value $V_0$.

FIG. 11A illustrates an example of the output value based on the output of the sensor 10 in a case in which the sub-hopper 200 does not store toner 206. The tip of the stirrer 205 contacts the weight 202 at a time $t_a$. As the stirrer 205 rotates, the vibration plate 201 is pressed along the inclined face of the weight 202, and the tip of the stirrer 205 departs from the weight 202 at a time $t_c$. In a period Tp from the time $t_a$ to the time $t_c$, since the vibration plate 201 gradually approaches the sensor 10, the output value based on the output of the sensor 10 increases in response to the distance between the vibration plate 201 and the sensor 10.

As the tip of the stirrer 205 departs from the weight 202, the vibration plate 201 vibrates according to the elasticity of the vibration plate 201 and weight of the weight 202. With this vibration, the vibration plate 201 repeats movements of approaching the sensor 10 and departing from the sensor 10 while decreasing the displacement of the vibration. The output value based on the output of the sensor 10 repeats increase and decrease across the reference value $V_0$ corresponding to the movement of the vibration plate 201 while decreasing a width of change of the output value. In the example in FIG. 11A, the output value based on the output of the sensor 10 converges on the reference value $V_0$ at a time $t_b$, which is elapsed from the time $t_c$ by a period $Tg_1$, and the vibration plate 201 stops vibrating.

FIG. 11B illustrates an example of the output value based on the output of the sensor 10 in a case in which the sub-hopper 200 stores toner 206 as illustrated in FIG. 10. In this example, the period Tp elapses similarly to the above-described example in FIG. 11A. In the example in FIG. 11B, after the tip of the stirrer 205 departs from the weight 202, the vibration plate 201 receives the resistance of toner 206. Therefore, the output value based on the output of the sensor 10 converges on the reference value $V_0$ at a time $t_b'$ earlier than the time $t_b$. A period $Tg_2$ from the time $t_c$ to the time $t_b'$ is measured, thereby estimating the amount of toner 206 stored in the sub-hopper 200.

Processing according to the present embodiment is described in more detail. The powder detector 30 according to the present embodiment monitors the output of the sensor 10 in a certain time range. In a case in which the displacement of the vibration plate 201 exceeds a threshold value based on the output of the sensor 10, the powder detector 30 determines that the tip of the stirrer 205 has flipped the vibration plate 201 and sets a position (a rotation angle of the rotary shaft 204) of the stirrer 205 at this timing as a home position HP. The powder detector 30 detects attenuation of the vibration of the vibration plate 201 starting from the home position HP. In addition, in a case in which the stirrer 205 stops rotating over a certain period, the powder detector 30 sets a position to stop the stirrer 205 starting from the home position HP.

With such a simple configuration, the powder detector 30 according to the present embodiment can determine a position to start detecting the vibration of the vibration plate 201 in order to detect the amount of toner in the sub-hopper 200. Since the powder detector 30 sets the position to stop the stirrer 205 starting from the home position HP in a case in which the stirrer 205 stops rotating over the certain period, the stirrer 205 can be reliably rotated to a position at which the tip of the stirrer 205 is not in contact with other components of the sub-hopper 200, thereby preventing the stirrer 205 from deforming due to contact with other components.

Figure 12:
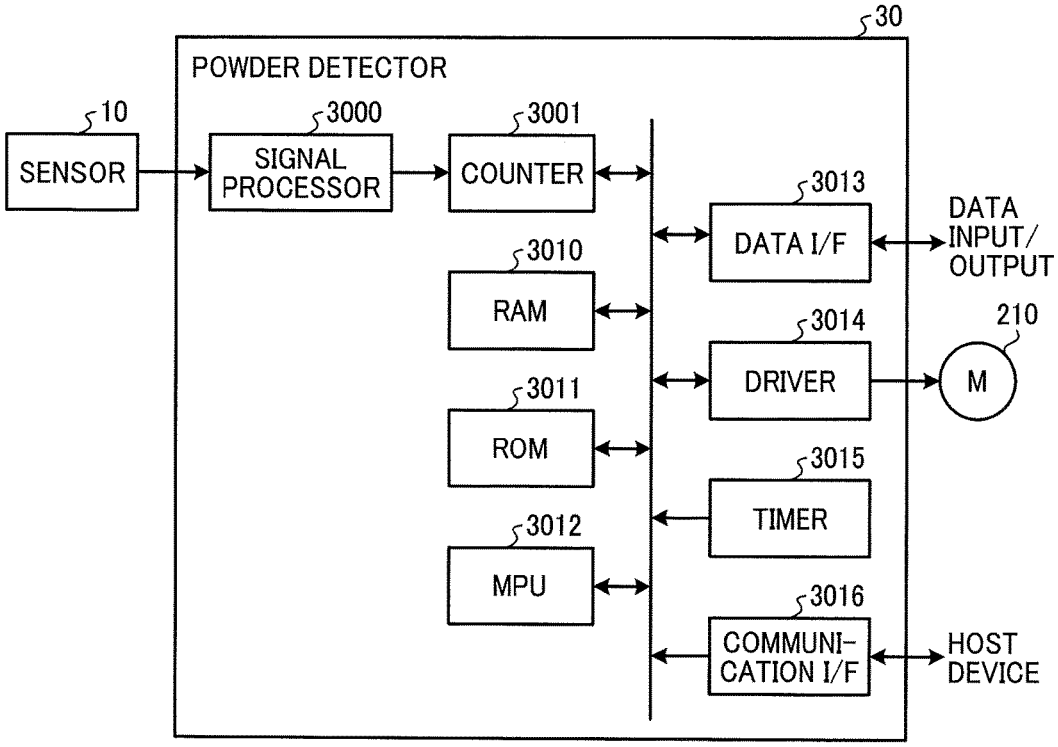
FIG. 12 is a block diagram illustrating a hardware configuration of a powder detector according to an embodiment of the present disclosure.

FIG. 12 is a block diagram illustrating an example of a hardware configuration of the powder detector 30 according to the present embodiment. In FIG. 12, the powder detector 30 includes a signal processor 3000, a counter 3001, a random access memory (RAM) 3010, a read only memory (ROM) 3011, a micro processing unit (MPU) 3012, a data interface (I/F) 3013, a driver 3014, a timer 3015, and a communication I/F 3016. Note that the Colpitts LC oscillator circuit described above is used as the sensor 10.

The signal processor 3000 performs a predetermined signal processing, such as noise removal, on the output with a square wave from the sensor 10. The counter 3001 counts the signal-processed square wave by the signal processor 3000 per predetermined time unit and outputs the count value. The predetermined time unit to count the output of the sensor 10 by the counter 3001 is, for example, shorter than one cycle of the vibration of the vibration plate 201 and weight 202.

The RAM 3010 is a storage medium that volatilely stores data, and the ROM 3011 is a storage medium that nonvolatilely stores data. The MPU 3012 controls overall operations of the powder detector 30 according to a program stored in the ROM 3011 in advance, using the RAM 3010 as a working memory.

The data I/F 3013 communicates input and output data with the outside of the powder detector 30. The data I/F 3013 can be an original I/F of the image forming apparatus 100 incorporating the powder detector 30 or a general-purpose I/F such as a universal serial bus.

The driver 3014 drives a motor 210 (indicated by "M" in FIGS. 12 and 13) according to an instruction of the MPU 3012. The motor 210 rotates the rotary shaft 204 to which the stirrer 205 is attached. The motor 210 is, for example, a stepping motor. For example, the driver 3014 generates a clockwise/counterclockwise (CW/CCW) signal and a drive pulse according to the instruction of the MPU 3012. The CW/CCW signal indicates the direction of rotation of the motor 210. The drive pulse is for driving the motor 210 by a predetermined rotation angle. The driver 3014 supplies the CW/CCW signal and the drive pulse generated by the driver 3014 to the motor 210.

The timer 3015 measures time according to the instruction of the MPU 3012 and outputs the measured time. The communication I/F 3016 communicates with devices outside the powder detector 30. For example, the communication I/F 3016 communicates with a host device, which is included in the image forming apparatus 100 incorporating the powder detector 30, relative to the powder detector 30.

Figure 13:
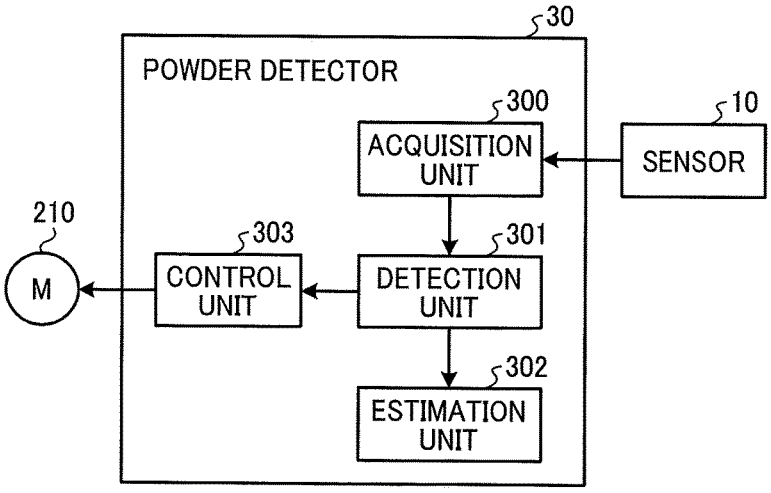
FIG. 13 is a functional block diagram of the powder detector according to an embodiment of the present disclosure.

FIG. 13 is a functional block diagram of the powder detector 30 according to the present embodiment. In FIG. 13, the powder detector 30 includes an acquisition unit 300, a detection unit 301, an estimation unit 302, and a control unit 303. The acquisition unit 300, the detection unit 301, the estimation unit 302, and the control unit 303 are implemented by a control program to operate on the MPU 3012. Not limited thereto, part of or entire acquisition unit 300, detection unit 301, estimation unit 302, and control unit 303 can be hardware circuitry to cooperatively operate each other.

The acquisition unit 300 acquires the output value based on the output of the sensor 10. As described above, the output value is the difference value obtained by subtracting the count values sequentially according to time series. The count value is a value obtained by counting the square wave output from the sensor 10. That is, the output value based on the output of the sensor 10 is a constant value, for example, "0", in the steady state of the vibration plate 201. In the vibration state, the output value vibrates across the constant value. In other words, the output value based on the output of the sensor 10 is the constant value in the steady state and repeats values higher and lower than the constant value in the vibration state.

The detection unit 301 detects the vibration of the vibration plate 201 based on the output value obtained by the acquisition unit 300. The estimation unit 302 estimates the amount of toner 206 stored in the sub-hopper 200 based on the vibration of the vibration plate 201 detected by the detection unit 301. For example, the estimation unit 302 estimates at least the presence or absence of toner 206 stored in the sub-hopper 200 based on the time until the vibration of the vibration plate 201 has converge.

The control unit 303 outputs the drive pulse to the driver 3014 to control rotation of the motor 210. The control unit 303 specifies the number of drive pulses to output to the driver 3014, thereby rotating the motor 210 by a desirable rotation angle. The control unit 303 stores the rotation angle of the motor 210 corresponding to the timing at which the detection unit 301 detects the vibration of the vibration plate 201 as the home position HP. Further, the control unit 303 sets a rotation angle to stop the motor 210 starting from the home position HP when the motor 210 is stopped over a certain period of time.

Note that, to stop the motor 210 over a certain period of time is defined as "halt the motor 210", and to stop the stirrer 205 at one position is defined as "halt the stirrer 205", using the word "halt".

The control program executed in the powder detector 30 according to the present embodiment are preliminarily installed in a memory device such as the ROM 3011. Alternatively, the control program executed in the powder detector 30 according to the present embodiment can be provided as files being in an installable format or an executable format and stored in a computer-readable recording medium, such as a compact disc (CD), a flexible disk (FD), and a digital versatile disc (DVD).

Alternatively, the control program executed in the powder detector 30 according to the present embodiment may be configured to be stored in a computer communicating with a network, such as the Internet, to be downloaded via the network. Thus, the program may be provided. Alternatively, the computer program executed in the powder detector 30 according to the present embodiment can be supplied or distributed via a network such as the Internet.

The control program executed in the powder detector 30 according to the present embodiment includes modules including the above-described units, such as the acquisition unit 300, the detection unit 301, the estimation unit 302, and the control unit 303. As the MPU 3012 as hardware reads out the program from the ROM 3011 and executes the program, the above-described functional units are loaded, and the acquisition unit 300, the detection unit 301, the estimation unit 302, and the control unit 303 are implemented (generated) in a main memory.

Figure 14A:
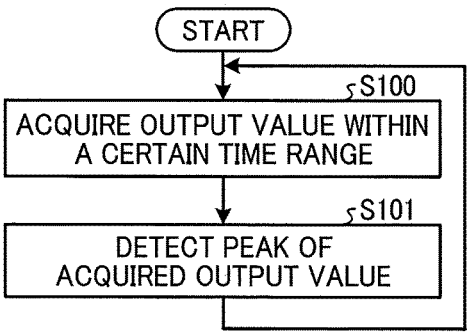
FIGS. 14A and 14B are flowcharts of a processing of the powder detector according to an embodiment of the present disclosure.

Referring to FIGS. 14A to 17, a description is given of the processing of the powder detector 30 according to the present embodiment in more detail. FIGS. 14A and 14B are flowcharts of examples of the processing of the powder detector 30 according to the present embodiment. FIGS. 15A to 15C are sequence diagrams of the processing of the powder detector 30 according to the present embodiment in a time series. FIG. 15A schematically illustrates an entire control flow of the powder detector 30, and FIG. 15B illustrates an example of the output value based on the output of the sensor 10. FIG. 15C illustrates an example of the drive pulse to drive the motor 210.

Figure 14B:
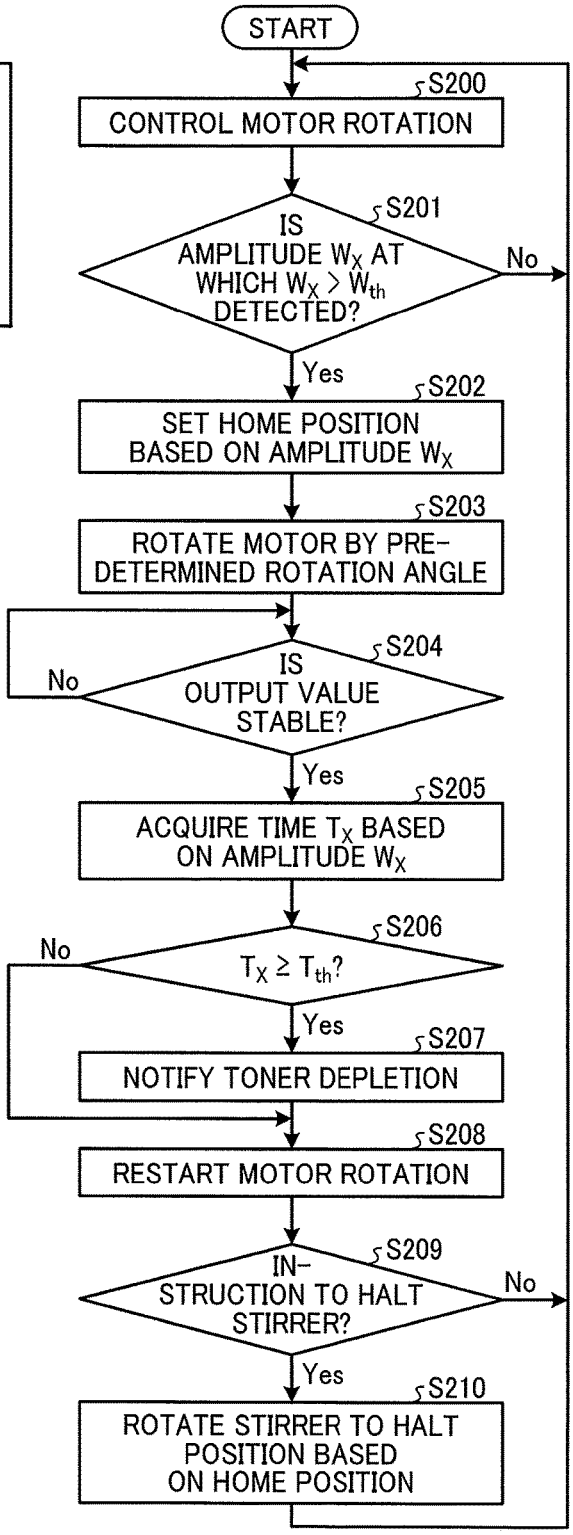

FIG. 14A is a flowchart illustrating an example of the processing of detecting based on the output of the sensor 10. FIG. 14B is a flowchart illustrating an example of processing of estimating the amount of toner and controlling the rotation of the motor 210 according to the present embodiment. The processing of the flowchart illustrated in FIG. 14B is concurrently executed with the processing in the flowchart illustrated FIG. 14A. The processing illustrated in FIG. 14B relates to each time in the sequence diagram in FIGS. 15A to 15C.

A description is provided of the processing in the flowchart in FIG. 14A. In step S100, the acquisition unit 300 acquires the output value based on the output of the sensor 10 in the certain time range. The acquisition unit 300 supplies the multiple output values included in the certain time range to the detection unit 301. In consideration of characteristic of the vibration plate 201, the certain time range when the acquisition unit 300 acquires the output value based on the output of the sensor 10 is preferably set so that the acquisition unit 300 does not erroneously detect an increase value of the output of the sensor 10 due to the rotation of the motor 210 and the fluctuation of the output of the sensor 10 due to the vibration plate 201.

In step S101, based on the output value supplied from the acquisition unit 300, the detection unit 301 detects a maximum peak and a minimum peak of the output value in the certain time range when the acquisition unit 300 acquires the output value based on the output of the sensor 10. Then, the detection unit 301 acquires an amplitude of the displacement of the vibration plate 201 based on the detected peaks. More specifically, the detection unit 301 acquires an absolute value of the difference between adjacent peaks of the output value in time series as a value corresponding to the amplitude of the displacement of the vibration plate 201.

After the processing of step S101, the process returns to step S100, and the processing of a next certain time range is executed. The next certain time range can include a period that overlaps the certain time range had been processed. Thus, the detection processing is cyclically executed.

Figures 15A, 15B, 15C:
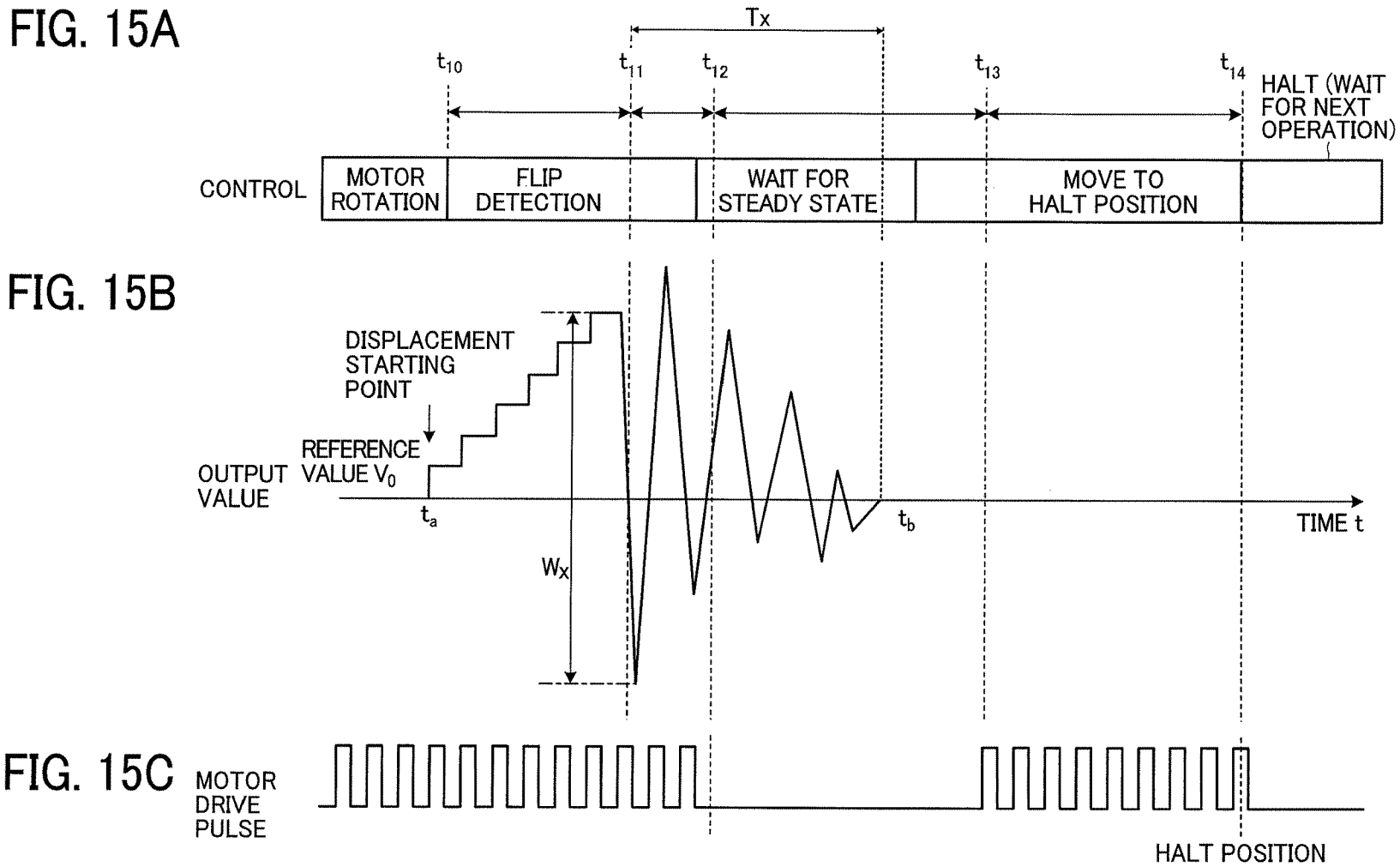
FIGS. 15A to 15C are sequence diagrams of the processing of the powder detector in time series according to an embodiment of the present disclosure.

A description is provided of the processing of the flowchart illustrated in FIG. 14B, in association with FIGS. 15A to 15C. In step S200, the control unit 303 controls the rotation of the motor 210. When the motor 210 is stopped, and the stirrer 205 is halted, the control unit 303 starts rotating the motor 210 from the position at which the stirrer is stopped. When the motor 210 is not stopped, the control unit 303 continuously rotates the motor 210.

In step S201, the control unit 303 determines whether the detection unit 301 detects an amplitude $W_x$ that exceeds a predetermined threshold value $W_{th}$. The amplitude $W_x$ is the amplitude of the displacement of the vibration plate 201 based on the output of the sensor 10 in step S101 of the flowchart in FIG. 14A. If the control unit 303 determines that the detection unit 301 has not detected the amplitude $W_x$ ("No" in step S201), the process returns to step S200.

On the other hand, in step S201, if the control unit 303 determines that the detection unit 301 has detected the amplitude $W_x$ that exceeds the threshold value $W_{th}$ ("Yes" in step S201), the process goes to step S202. As the detection unit 301 has detected the amplitude $W_x$ that exceeds the threshold value $W_{th}$, the control unit 303 determines that the stirrer 205 has flipped the vibration plate 201. The position (time) at which the detection unit 301 has detected the amplitude $W_x$ is the timing at which the stirrer 205 has flipped the vibration plate 201.

Figure 16:
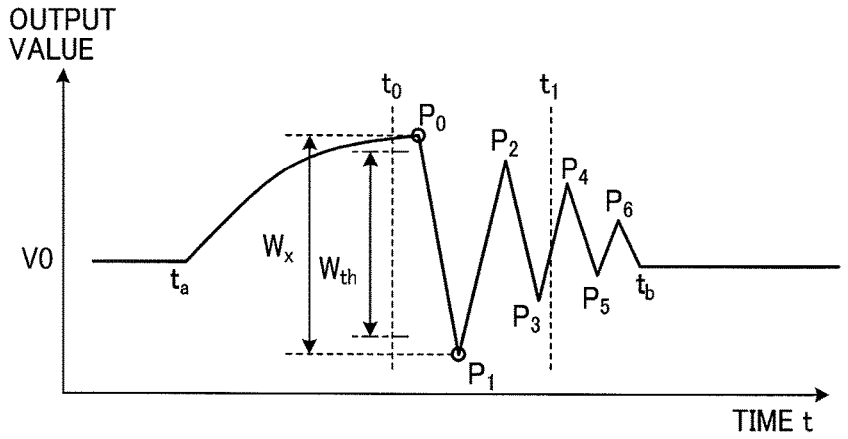
FIG. 16 is a graph illustrating a determination based on a threshold value Wth according to an embodiment of the present disclosure.

Referring to FIGS. 15B and 16, a description is provided of the determination based on the threshold value $W_{th}$ in step S201 according to the present embodiment. FIG. 16 corresponds to FIGS. 11A and 11B described above. A vertical axis represents the output value based on the output of the sensor 10, and a horizontal axis represents the time t. A reference value $V_0$ is indicated on the vertical axis.

The time $t_a$ in FIGS. 15B and 16 indicates the timing at which the tip of the stirrer 205 has contacted the weight 202. At the time $t_a$, as the stirrer 205 rotates, the weight 202 is pressed toward the sensor 10 by the tip of the stirrer 205. Accordingly, the output value based on the output of the sensor 10 start increasing from the reference value $V_0$. In other words, the output value based on the output of the sensor 10 start changing from the time $t_a$ as the displacement starting point.

The detection unit 301 acquires the maximum peak and the minimum peak in the time range between the present time (time $t_1$) and the time $t_0$ when going back a certain time from the present time.

Referring to FIG. 16, more specifically, a description is provided of the processing of acquiring the peak of the output value based on the output of the sensor 10 by the detection unit 301. For example, the detection unit 301 calculates the difference between the adjacent output values in time series regarding each output value supplied from the acquisition unit 300 between the time $t_0$ and the time $t_1$. The detection unit 301 acquires positions at which positive and negative sign of the difference is reversed as the maximum point or the minimum point of the output value and the output value at the maximum point and the minimum point. In the example in FIG. 16, points $P_0$ and $P_2$ are acquired as the maximum point, and points $P_1$ and $P_3$ are acquired as the minimum point between the times $t_0$ and $t_1$.

The detection unit 301 calculates the difference between the output values of the adjacent maximum point and minimum point in time series and detects the absolute value of the difference as the amplitude of the displacement of the vibration plate 201. In the example in FIG. 16, the differences $|P_0-P_1|$, $|P_1-P_2|$, and $|P_2-P_3|$ are detected as the amplitude of the displacement of the vibration plate 201. The control unit 303 detects the amplitude $W_x$ that exceeds the threshold value $W_{th}$ among the differences $|P_0-P_1|$, $|P_1-P_2|$, and $|P_2-P_3|$. In the example in FIG. 16, the control unit 303 detects $|P_0-P_1|$ as the amplitude $W_x$.

When the control unit 303 detects multiple amplitudes $W_x$ that exceeds the threshold value $W_{th}$ in the certain time range, the control unit 303 adopts the earliest amplitude $W_x$ in time series among the detected multiple amplitudes.

In the powder detector 30, a flip detection period for detecting magnetic movement of the vibration plate 201 (the weight 202) by the stirrer 205 is the period between the time $t_a$ and the time $t_1$. The time $t_a$ is the displacement starting point of the output value based on the output of the sensor 10, and the time $t_1$ is the starting point, from which going back the certain time, for detecting peaks (see FIG. 15A).

Referring back to FIG. 14B, the control unit 303 sets the home position HP based on the amplitude $W_x$ that exceeds the threshold value $W_{th}$ in step S202. For example, the control unit 303 sets a position corresponding to a time $t_{11}$ at the midpoint between the points $P_0$ and $P_1$ as the home position HP. Note that, the position described above is indicated by the rotation angle of the motor 210. The control unit 303 stores the rotation angle of the motor 210 at the home position HP.

The home position HP is not limited to the above-described position. Alternatively, the point $P_0$ that is the maximum point of the amplitude $W_x$ or the point $P_1$ that is the minimum point of the amplitude $W_x$ can be the home position HP.

In step S203, the control unit 303 rotates the motor 210 from the home position HP by a predetermined rotation angle and stop the motor 210 (see a time t12 in FIGS. 15A to 15C) so that the stirrer 205, which flips the vibration plate 201, is not stopped in contact with the vibration plate 201.

Further, after the detection unit 301 detects that the stirrer 205 has flipped the vibration plate 201 (the weight 202), the detection unit 301 continuously detects the peak of the output value based on the output of the sensor 10 while the stirrer 205 stops rotating. Therefore, the detection unit 301 can accurately detect the timing at which the stirrer 205 has flipped the vibration plate 201.

In step S204, the detection unit 301 determines whether the output value based on the output of the sensor 10 has stabilized. For example, when the difference between the output values of the maximum point and the minimum point is equal to or lower than a predetermined value, the detection unit 301 determines that the output value based on the output of the sensor 10 has stabilized. The stability of the output value based on the output of the sensor 10 means that the vibration of the vibration plate 201 converges. When the detection unit 301 determined that the output value based on the output of the sensor 10 is not stable ("No" in step S204), the process returns to step S204.

When the detection unit 301 determined that the output value based on the output of the sensor 10 is stable ("Yes" in step S204), the process goes to step S205. In example in FIGS. 15B and 16, the detection unit 301 determines that the output value based on the output of the sensor 10 has stabilized at the time $t_b$ at which the output value of the sensor 10 converges on the reference value $V_0$.

In the powder detector 30, a waiting period for waiting stability of the output value based on the output of the sensor 10 is the period between the time $t_1$ and the time $t_b$. The time $t_1$ is the starting point, from which going back the certain time, for detecting peaks, and the time $t_b$ is when the detection unit 301 determines that the output value based on the output of the sensor 10 is stable (see FIG. 15A).

In step S205, the estimation unit 302 acquires a time $T_x$ from the time corresponding to the amplitude $W_x$ detected in step S201 to the time when the detection unit 301 determines that the output value based on the output of the sensor 10 is stable in step S204. In step S206, the estimation unit 302 determines whether the time $T_x$ acquired in step S205 is equal to or more than a predetermined threshold time $T_{th}$. In step S206, if the estimation unit 302 determines that the time $T_x$ does not exceeds the threshold time $T_{th}$ ("No" in step S206), the process goes to step S208.

On the other hand, if the estimation unit 302 determines that the time $T_x$ is equal to or more than the threshold time $T_{th}$ ("Yes" in step S206), the process goes to step S207. In step S207, the estimation unit 302 determines that toner 206 in the sub-hopper 200) is depleted. That is, toner 206 in the toner bottle 117 is also depleted, and the estimation unit 302 outputs a notification of toner depletion. The notification of toner depletion is output to the outside of the powder detector 30, for example, via the data I/F 3013.

Thus, the powder detector 30 according to the present embodiment determines the timing at which the stirrer 205 has flipped the vibration plate 201, and the vibration plate 201 starts vibrating according to whether the amplitude $W_x$ of the displacement of the vibration plate 201 exceeds the threshold value $W_{th}$ based on the output value based on the output of the sensor 10 for detecting the displacement of the vibration plate 201. With such a simple configuration, the powder detector 30 according to the present embodiment can determine a position to start detecting the vibration of the vibration plate 201 in order to detect the amount of toner in the sub-hopper 200 without an additional component.

In the above-described embodiment, the estimation unit 302 determines the presence or absence of toner 206 in the sub-hopper 200, but not limited to the above-described embodiment. For example, the estimation unit 302 can determine the amount of toner 206 in the sub-hopper 200 based on the time $T_x$.

In the above-described embodiment, the estimation unit 302 determines the presence or absence of toner 206 in the sub-hopper 200 based on whether the output value based on the output of the sensor 10 is within the predetermined value, but not limited to the above-described embodiment. For example, the presence or absence of toner 206 in the sub-hopper 200 can be determined based on the attenuation rate of the output value.

In step S208, the control unit 303 restarts the rotation of the motor 210, which is stopped in step S203 (see a time $t_{13}$ in FIGS. 15A to 15C). In step S209, the control unit 303 determines whether the control unit 303 has received an instruction to halt the stirrer 205 from the host device.

For example, when the image forming apparatus 100 including the powder detector 30 is turned off, the host device outputs the instruction to halt the stirrer 205 to the powder detector 30. The image forming apparatus 100 adjusts the supply of toner 206 to the developing device 112 according to print content currently being printed. For example, when the print content includes several words or a few lines per page, the supply of toner 206 to the developing device 112 is decreased. When there is a color that is not involved in printing among colors of cyan, magenta, yellow, and black, the supply of toner 206 to the developing device 112 corresponding to the color is decreased. In such a case, the control unit 303 intermittently rotates the stirrer 205 in the sub-hopper 200. For example, the control unit 303 stops the motor 210 for each rotation of the stirrer 205 and halts the stirrer 205.

When the control unit 303 determines that the control unit 303 has not received the instruction to halt the stirrer 205 from the host device ("No" in step S209), the process returns to step S200. On the other hand, when the control unit 303 determines that the control unit 303 has received the instruction to halt the stirrer 205 from the host device ("Yes" in step S209), the process goes to step S210.

In step S210, the control unit 303 rotates the motor 210 to the rotation angle corresponding to the halt position of the stirrer 205 based on the rotation angle of the home position HP and stops the motor 210 (see the time $t_{14}$ in FIGS. 15A to 15C). As described later, the stirrer 205 is not in contact with other components in the sub-hopper 200 at the halt position of the stirrer 205.

The control unit 303 is on standby for next operation after the control unit 303 stops the motor 210 at the halt position of the stirrer 205 in step S210. As the control unit 303 receives an instruction to rotate stirrer 205 from, for example, the host device, the process returns to step S200.

Figure 17:
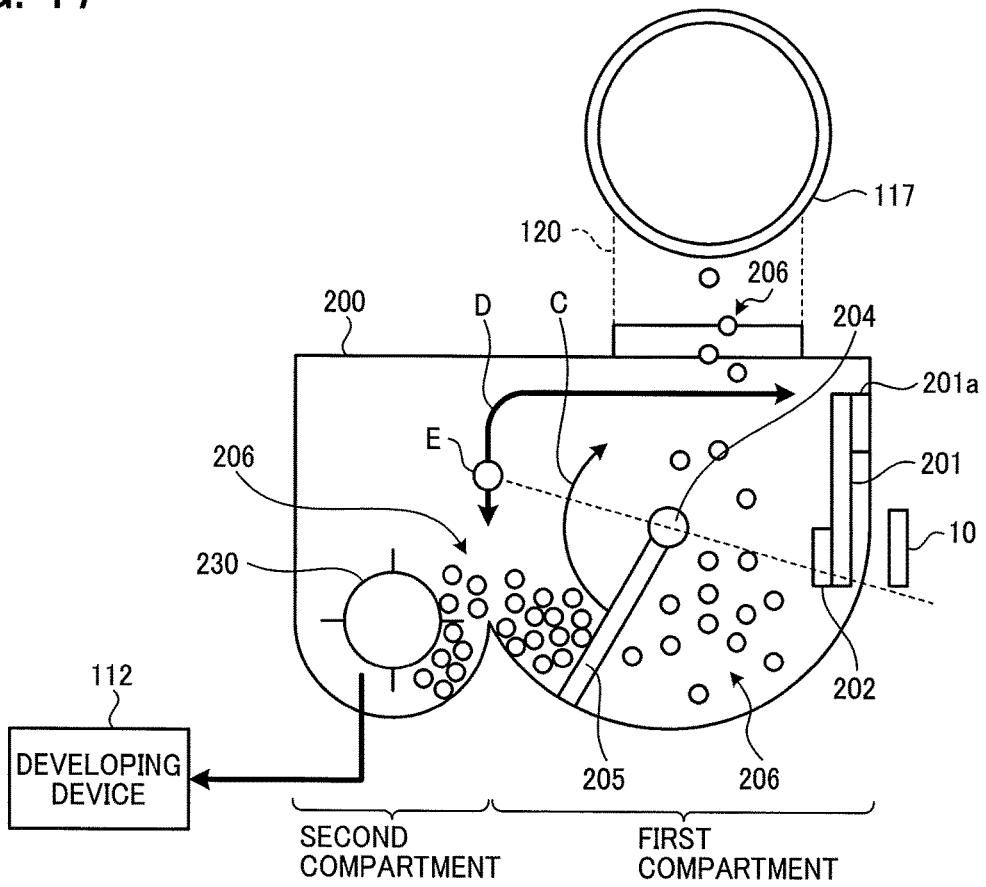
FIG. 17 is a schematic view of the sub-hopper illustrating setting of a halt position of the stirrer according to an embodiment of the present disclosure.

FIG. 17 is a schematic view of the sub-hopper 200 illustrating setting of the halt position of the stirrer 205. Note that, in FIG. 17, identical reference numerals are assigned to components that are identical to the components illustrated in FIGS. 2 to 4B and 10, and a description of the identical components is omitted. As illustrated in FIG. 17, the sub-hopper 200 includes a first compartment including the stirrer 205 and a second compartment including a screw 230. The stirrer 205 rotates clockwise as indicated by arrow C in FIG. 17.

In FIG. 17, toner 206 contained in the toner bottle 117 is supplied through the first toner supply passage 120 to the first compartment of the sub-hopper 200. Toner 206 supplied to the first compartment is stirred by the stirrer 205 rotated by the motor 210 and raked out from the first compartment to the second compartment including the screw 230. Toner 206 in the second compartment of the sub-hopper 200 is discharged by the screw 230 to the developing device 112. In the example in FIG. 17, the vibration plate 201 is disposed on an inner surface of a wall of the first compartment of the sub-hopper 200 on the side opposite to the second compartment relative to the rotation center of the stirrer 205. The sensor 10 is disposed outside the sub-hopper 200, facing the vibration plate 201 via the wall of the first compartment.

As illustrated in FIG. 17, as the stirrer 205 rotates, the tip of the stirrer 205 sweeps the curved surface of the bottom portion of the sub-hopper 200) and rakes out toner 206 staying in the bottom portion from the first compartment to the second compartment. As the stirrer 205 further rotates from the above-described state, the tip of the stirrer 205 presses the weight 202 (vibration plate 201). Accordingly, the sensor 10 detects the weight 202 to be pressed.

Thus, the stirrer 205 is in contact with the inner surface of the sub-hopper 200 while raking out toner 206 and in contact with the weight 202 while pressing the weight 202. In a case in which the stirrer 205 is made of resin in consideration of flexibility, if the stirrer 205 stops rotating in contact with the inner surface of the sub-hopper 200 or the weight 202, the stirrer 205 may be non-plastically deformed. If the stirrer 205 is deformed, the stirrer 205 does not sufficiently press the weight 202, and the accuracy to detect the timing at which the stirrer 205 has flipped the vibration plate 201 may be decreased.

Therefore, in the powder detector 30 according to the present embodiment, the stirrer 205 is not in contact with other components of the sub-hopper 200 at the halt position of the stirrer 205. For example, the halt position of the stirrer 205 is set within a range including an opening between the first compartment and the second compartment, an opening of the first toner supply passage 120, and a portion between the two opening. The range is indicated by arrow D in FIG. 17.

At that time, the both ends of the respective two openings in the axial direction of the rotary shaft 204 are not in contact with the stirrer 205. In the upper surface of the sub-hopper 200, the portion between the two openings is located higher than the opening or than the rotation radius of the tip of the stirrer 205 from the rotation center of the stirrer 205.

After start of the next rotation of the motor 210, if toner 206 in the sub-hopper 200 is not stirred to some extent until the tip of the stirrer 205 flips the vibration plate 201 (the weight 202), the notification of toner depletion may be delayed. Therefore, the halt position of the stirrer 205 is preferably separated from the vibration plate 201 by a predetermined distance or more. In the configuration in FIG. 17, for example, the halt position of the stirrer 205 can be closer to screw 230. Alternatively, for example, the halt position of the stirrer 205 can be symmetrical about the center of the rotary shaft 204 relative to the vibration plate 201 as the position E illustrated in FIG. 17.

Note that, in a case of using a stepping motor as the motor 210, when the motor 210 transfers to the state in which the excitation is released after the motor 210 stops or the state in which the power is turned off, a stop position of the motor 210 may be somewhat shifted. Therefore, the halt position of the stirrer 205 preferably has margins in forward and backward directions.

The halt position of the stirrer 205 is preset. In addition, the position of the stirrer 205 and the number of drive pulses per rotation of the motor 210 are known. Accordingly, since the halt position of the stirrer 205 is preliminarily stored as the number of drive pulses from the position of the vibration plate 201, for example, in the ROM 3011, the detection unit 301 can detect the timing at which the stirrer 205 has flipped the vibration plate 201 (the weight 202) with high accuracy when the stirrer 205 rotates the next time after halting at the halt position. Such a configuration can suppress erroneous detections of the amplitude of the displacement of the vibration plate 201, and the accuracy of the notification of toner depletion can be increased.

In a case in which an initial position of the motor 210 is reset due to turn off of the apparatus, the motor 210 is driven according to the drive pulse indicating the halt position of the stirrer 205 from the starting point at which the tip of the stirrer 205 has flipped the vibration plate 201 (the weight 202). The drive pulse is stores in advance. As a result, the stirrer 205 is reliably moved to the halt position.

Figure 18:
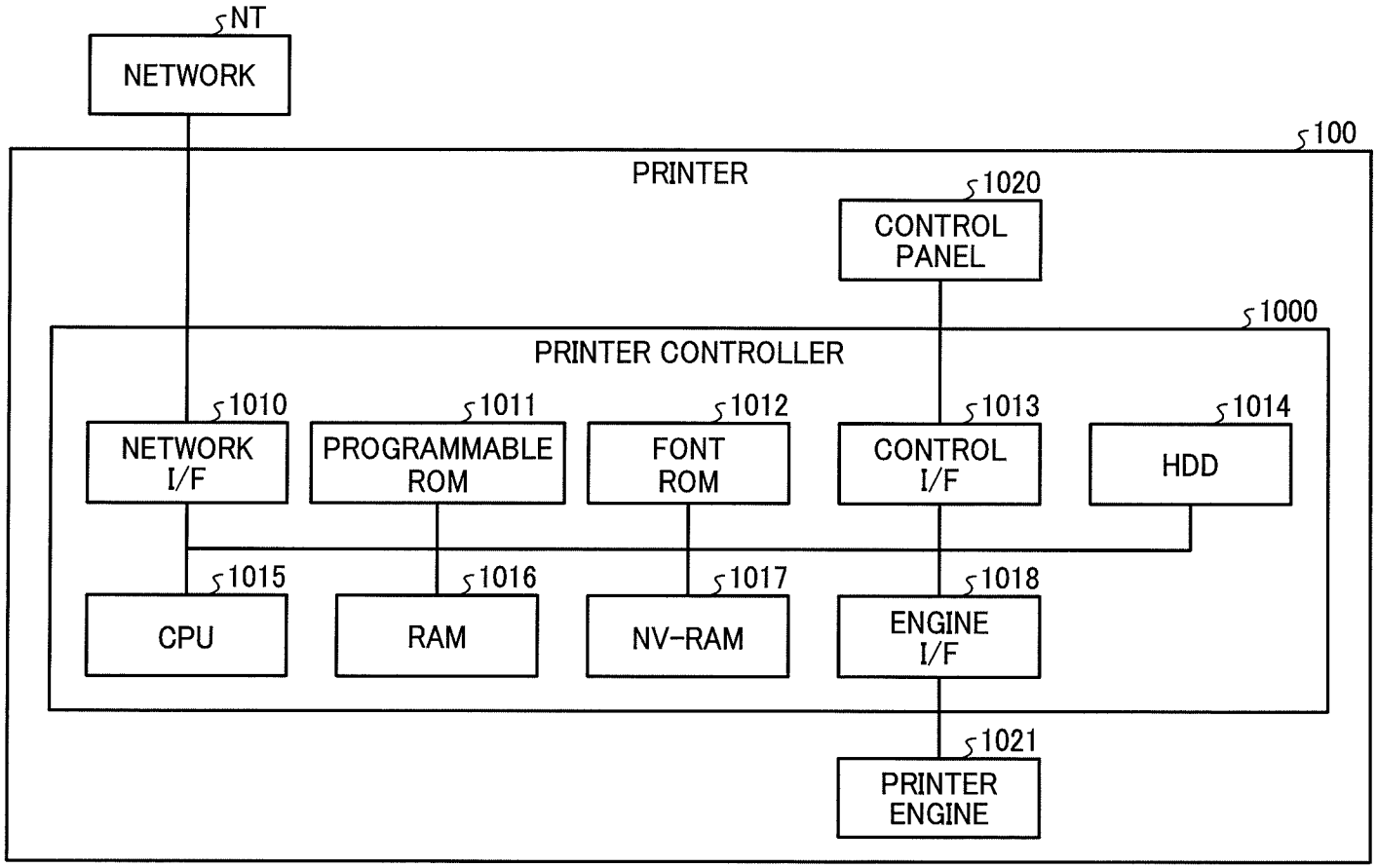
FIG. 18 is a block diagram illustrating an entire hardware structure of the image forming apparatus according to an embodiment of the present disclosure.

FIG. 18 is a block diagram illustrating an example of an entire hardware structure of the image forming apparatus 100 according to the present embodiment. In FIG. 18, the image forming apparatus 100 (the example in FIG. 18 is a printer) includes a printer controller 1000 to control the body of the image forming apparatus 100, a printer engine 1021 to form an image on a recording medium, and a control panel 1020 to input data by users and display states of the body of the image forming apparatus 100. The image forming apparatus 100 is connected to a network NT. The image forming apparatus 100 can communicate to, for example, a host computer to instruct printing through the network NT.

The printer engine 1021 controls the image forming units 106K, 106C, 106M, and 106Y according to signals from the printer controller 1000 and feeds a transfer sheet as the recording medium from sheet feeding tray 101, thereby forming an image on the transfer sheet. The control panel 1020 is a user I/F including an input device to accept an input by users and a display device to display the states of the body of the image forming apparatus 100.

The printer controller 1000 is a control mechanism that converts printing data from the host computer to image data and outputs the image data to the printer engine 1021 according to a control mode currently set and a control code received from the host computer. The printer controller 1000 includes modules, such as a network I/F 1010, a programmable ROM 1011, a font ROM 1012, a control I/F 1013, a central processing unit (CPU) 1015, a RAM 1016, a nonvolatile (NV-) RAM 1017, an engine I/F 1018, and a hard disk drive (HDD) 1014, and corresponds to the above-described host device. A nonvolatile semiconductor memory such as a flash memory can be used instead of the HDD 1014.

Each module functions as follows. The network I/F 1010 controls communication through the network NT. The programmable ROM 1011 stores programs to administrate data in the printer controller 1000 and control peripheral modules. The font ROM 1012 stores various kinds of fonts used for printing. The control I/F 1013 is an interface for the control panel 1020.

The CPU 1015 treats data including instructions for printing, such as print data and control data, transmitted from the host computer through the network NT according to the programs stored in the programmable ROM 1011. The RAM 1016 is a work memory the CPU 1015 use at rum time and is used as a buffer to temporally store data from the host computer and a memory to treat data stored in the buffer.

The NV-RAM 1017 is a nonvolatile memory to store data, such as setting data, that is retained even when the power is turned off. The engine I/F 1018 is an interface to control the printer engine 1021 from the printer controller 1000. The HDD 1014 is a large capacity storage device to store large capacity data readably and writably.

A description is provided of a variation of the above-described embodiment. In the above-described embodiment, the stepping motor is used as the motor 210, but not limited thereto. Other types of motors can be adopted as the motor 210 if the phase of the rotation can be controlled. For example, a brushless direct current (DC) motor driven by a DC power supply is adopted as the motor 210. As one example, the motor 210 has the number of motor pole pairs N, 2N (N=1, 2, . . . ), and the driver 3014 supplies drive signals including three phases (U-phase, V-phase, and W-phase) to the motor 210, thereby rotating the motor 210. The control unit 303 controls the rotation of the motor 210 with the drive signals, thereby moving the stirrer 205 to the halt position.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A powder detector comprising:

a driver to drive a motor;

a stirrer to stir powder in a vessel;

a vibration plate disposed in the vessel and vibrated by a flip of the stirrer rotated by the motor; and circuitry configured to:

detect a vibration of the vibration plate;

estimate an amount of powder based on a detection result of the vibration; and cause the driver to drive the motor from a starting point, so as to move the stirrer to a preset halt position, and cause the driver to stop drive of the motor before the stirrer has moved one complete rotation from the starting point, the starting point being a rotation angle of the motor at a time of detection of the vibration.

2. The powder detector according to claim 1, wherein the preset halt position is a position at which the stirrer is not in contact with any of an inner surface of the vessel and the vibration plate.

3. The powder detector according to claim 1, wherein the preset halt position is a position at which a distance between the vibration plate and an end of the stirrer in a radial direction relative to a rotation center of the stirrer is a predetermined value or more.

4. The powder detector according to claim 1, wherein the circuitry stores the rotation angle of the motor when the stirrer halts, and wherein the circuitry estimates the starting point based on the rotation angle stored, when the stirrer restarts rotating.

5. The powder detector according to claim 1, wherein the preset halt position has a predetermined margin.

6. The powder detector according to claim 1, wherein the circuitry detects the vibration of the vibration plate based on change of magnetic flux in response to the vibration of the vibration plate.

7. An image forming apparatus comprising:

the powder detector according to claim 1, to detect the amount of powder in the vessel; and an image forming unit including:

a photoconductor to bear an electrostatic latent image; and a developing device to develop the electrostatic latent image on the photoconductor to a visible image with the powder supplied from the vessel.

8. A method of controlling a powder detector, the method comprising:

driving a motor;

stirring powder in a vessel by a stirrer rotated by the motor;

detecting a vibration of a vibration plate disposed in the vessel and vibrated by a flip of the stirrer rotated by the motor;

estimating an amount of powder based on a detection result of the vibration; and driving the motor from a starting point, so as to move the stirrer to a preset halt position, and stopping drive of the motor before the stirrer has moved one complete rotation from the starting point, the starting point being a rotation angle of the motor at a time of detection of the vibration.

* * * * *